United States Patent [19]

Nilsson

[11] Patent Number: 4,628,818

[45] Date of Patent: Dec. 16, 1986

[54] SHORT CIRCUIT SPRING FOR AN ELECTRICAL CONNECTOR

[75] Inventor: Karl E. Nilsson, Ottobrun, Fed. Rep. of Germany

[73] Assignee: Bayern-Chemie Gesellschaft fuer flugchemische Antriebe mbH, Aschau a. Inn, Fed. Rep. of Germany

[21] Appl. No.: 655,757

[22] Filed: Sep. 28, 1984

[30] Foreign Application Priority Data

Oct. 27, 1983 [DE] Fed. Rep. of Germany ..... 3338929

[51] Int. Cl.[4] ..... F42B 3/10

[52] U.S. Cl. ..... 102/202.2; 102/202.3; 102/262; 339/19; 339/95 D

[58] Field of Search ..... 102/202.1, 202.3, 262, 102/202.2; 339/19, 95 R, 95 D

[56] References Cited

U.S. PATENT DOCUMENTS

| | | | |
|---|---|---|---|
| 3,274,937 | 9/1966 | Kyle | 102/202.1 X |
| 3,393,397 | 7/1968 | Manichl | 339/95 D |
| 3,585,933 | 6/1971 | Kos | 102/202.1 |
| 4,217,021 | 8/1980 | Illum | 339/95 D |
| 4,271,453 | 6/1981 | Yajima et al. | 102/202.3 X |
| 4,353,610 | 10/1982 | Deters | 339/19 |
| 4,482,198 | 11/1984 | Crowley | 339/19 |
| 4,516,817 | 5/1985 | Deters | 339/95 D X |

FOREIGN PATENT DOCUMENTS

| | | | |
|---|---|---|---|
| 2830552 | 7/1978 | Fed. Rep. of Germany . | |
| 3225698 | 1/1984 | Fed. Rep. of Germany | 339/95 D |
| 2524721 | 10/1983 | France | 339/95 D |

*Primary Examiner*—Peter A. Nelson

*Attorney, Agent, or Firm*—W. G. Fasse; D. H. Kane, Jr.

[57] ABSTRACT

A short circuit spring for an electrical connector, such as a plug-in connector, has a flat leaf spring section and a curved leaf spring section. A first hole in the flat section fits snugly in a contact making manner around an electrical terminal while a second hole in the flat section is large enough to permit a second terminal to pass through without contact. The curved section forms a tongue bent back to contact the second terminal with a tongue edge when the connector is not plugged together with a second connector to maintain a short circuit and to interrupt the short circuit when the connectors are plugged together.

9 Claims, 2 Drawing Figures

SHORT CIRCUIT SPRING FOR AN ELECTRICAL CONNECTOR

FIELD OF THE INVENTION

The invention relates to a short circuit spring for an electrical connector such as a plug-in connector, used for example, for pyrotechnical purposes. Such a plug-in connector has two connector members, one of which is equipped with the short circuit spring to provide a safety feature for pyrotechnical elements. As long as the two connector elements are disconnected the ignition circuit for the pyrotechnical elements is short circuited. When the two connector elements are plugged together, the short circuit is interrupted but reestablished upon disconnection of the two corresponding or compatible connector members.

DESCRIPTION OF THE PRIOR ART

Many different safety devices are known in the art for protecting electrically ignitable or explodable pyrotechnical elements. Such safety devices are used for military as well as civil safety purposes for pyrotechnical elements which can be ignited, especially by relatively small electrical power. As a result of such relatively small electrical power required for the ignition, such pyrotechnical elements have a high sensitivity for static charges and for other voltages that may occur in an uncontrolled manner. Thus, there is a danger of an undesired ignition of a pyrotechnical element when such safety devices are not used. On the other hand, by short circuiting the two electrical inlet conductors of a pyrotechnical element it is possible to substantially completely prevent such undesired ignitions or explosions.

Prior art safety devices comprise, for example bails or seals which are maintained in place until the pyrotechnical device is used, whereupon the removal of the safety device from the connecting electrodes or terminals is irreversible and the previously established short circuit of these terminals cannot be reestablished. Thus, if it should become necessary to again remove the pyrotechnical element from a system, it is not possible to provide the required protection against an undesired ignition or explosion.

German Patent Publication (DE-OS) No. 2,830,552 discloses a short circuit safety device for electrical igniters, which establishes a short circuit contact by means of contact springs. These springs are elongated leaf springs which extend substantially in parallel to the electrodes or terminals. The leaf springs contact each other and are, if desired, electrically connected with the detonator housing. However, short circuit springs of this type have a number of disadvantages in their practical use. For example, it is unfavorable to require a contact spring with a contact tongue having a spring angle of up to 45°. Such a feature leads to an undesirable bending or even breaking of the contact tongues, especially where a plug-in type contact is involved which must be used repeatedly. Such failures are due to material fatigue which is more pronounced at such large spring angles.

On the other hand, where a flat contact tongue contacts a terminal, corrosion effects may lead to an interruption of the short circuit contact since a desirable self-cleaning action is absent.

It is further desirable that such short circuit springs should be manufacturable in large numbers at low costs, namely with a few manufacturing steps and with a small expense for the spring material. Additionally, such springs ought to be mountable and adjustable by simple means. These desirable features are not available in the prior art.

OBJECTS OF THE INVENTION

In view of the above it is the aim of the invention to achieve the following objects singly or in combination:

to construct a short circuit spring for a connector, especially a plug-in type connector in such a manner that upon completion of the connection the short circuit is interrupted while it is reestablished when the connection is unplugged;

to construct a short circuit spring which is especially suitable for use in connection with pyrotechnical and/or military detonators or the like;

to make sure that the short circuiting feature is maintained as long as the plug-in connection is incomplete or faulty; and to construct the short circuiting spring so that additional insulating means are not necessary.

SUMMARY OF THE INVENTION

A short circuit spring according to the invention has, prior to its being bent, the shape of an approximately rectangular leaf spring which extends with its surface preferably perpendicularly to two electrodes or terminals which extend in parallel to each other. If the terminals are round, the leaf spring comprises in its flat section a first aperture having a round cross-section and a second aperture, for example, with a longitudinal cross-section. Preferably, the apertures are centered on a line which forms an axis of symmetry centrally between the longitudinal edges of the flat spring section. The diameter of the round aperture is smaller or at least equal to the diameter of the respective electrode or terminal so that the latter is snugly received in said first aperture with an electrical contact between the spring and the terminal. The elongated aperture is wider than the diameter of the other electrode or terminal so that an electrical contact between the flat spring section and the other terminal is avoided. After the bending the leaf spring is provided with a bent section at one end thereof which thus forms a spring tongue bent back against the other terminal so that an edge of the bent back curved spring section rests with a spring bias against the other terminal as long as the connector is not connected to a compatible,corresponding connector. Preferably, the smaller bending radius of the tongue is located closer to the other terminal than the larger bending radius to provide the desired spring bias.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
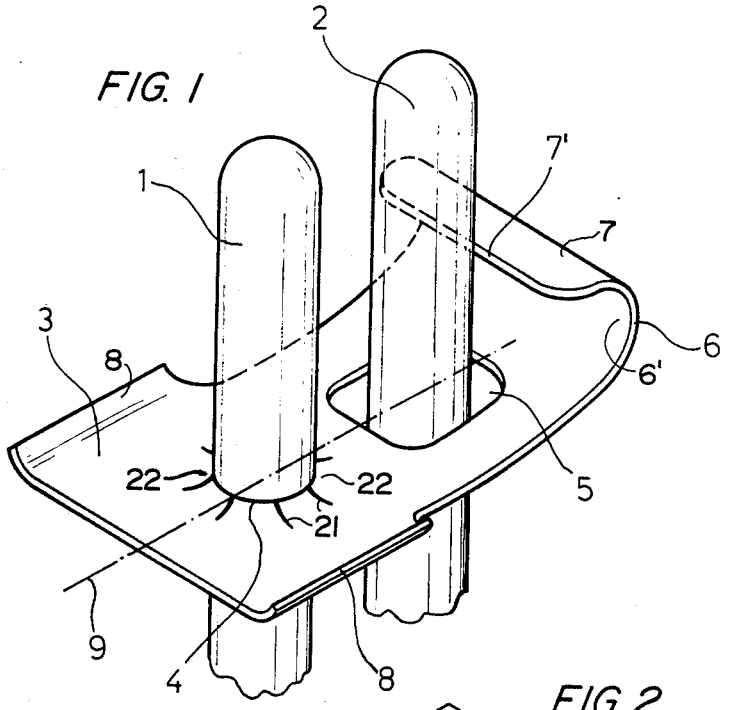
FIG. 1 is a perspective view of the short circuit spring according to the invention.

FIG. 1 shows on an enlarged scale an example embodiment of a short circuit spring according to the invention in its safety, short circuiting position. Two electrode pins or terminals 1 and 2 extending in parallel to each other are conventionally held in a first connector, for example, in the form of an insulating material housing not shown for simplicity's sake since it is not part of the invention. The insulating housing of the first connector electrically insulates the terminals 1 and 2 from each other. These terminals are ccnventionally connected to a detonating circuit, for example.

The short circuit spring according to the invention comprises a spring body 3 having initially a substantially rectangular shape with a first flat section at one end thereof and a second curved section 7 after the rectangular shape has been curved at the other end. The curved section 7 forms a tongue with a contact edge 7′ which normally engages the terminal 2 under a spring bias caused by the curved section 7 when the first connector is disengaged from a second connector 20 shown schematically in FIG. 2. The flat section of the spring body 3 is provided with two apertures 4 and 5. The aperture 4 has a diameter corresponding to or slightly smaller than the diameter of the first terminal 1 so that the latter is received with a force fit in the aperture 4 thereby providing an electrical contact between the terminal 1 and the spring body 3.

If desired, the edge around the aperture 4 may be provided with slots 21 to form individual spring elements 22 which tightly grip the terminal 1 in a spring type clamping action to hold the spring in place on the terminal 1.

The second aperture 5 has such a size, for example, in the form of an elongated hole, that it is spaced from the second terminal 2 all around.

Figure 2:
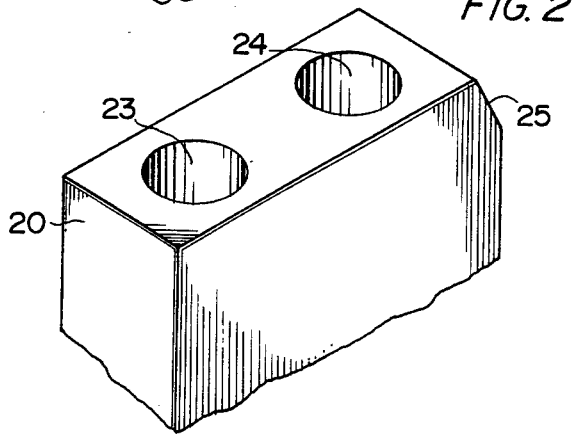
FIG. 2 is a perspective view of a connector member adapted for cooperation with a connector member comprising the spring as shown in FIG. 1.

FIG. 2 shows schematically a second connector 20 with holes 23 and 24 conventionally provided with contacts for cooperation with the terminals 1 and 2 when the first and second connectors are joined to each other. According to the invention one side of the connector 20 is provided with a ramp 25 for facilitating the separation of the contact edge 7′ from the terminal 2 when the two connectors are joined to each other.

The short circuit spring is manufactured by first stamping respective strips out of an elongated spring steel tape or the like. In the next step, the other end of the initially flat spring body is curved over, for example, to assume the approximate shape of a parabola as best seen in FIG. 1, whereby the smaller radius of curvature 6′ on the inside of the curvature forming the tongue 7 is closer to the aperture 5 than the outside curvatures 6. The contact edge 7′ is preferably forming a self-cleaning cutting edge to provide a sure contact with the terminal. However, it has been found that the contact edge may also be curved, for example to form a tubular type contact edge. Such an edge also provides safe short circuiting contacts as long as the two connectors are disengaged.

The contact tongue 7 has such flexible spring characteristics that the pressure exerted by the second connector 20 on the contact edge 7′ causes a further curling motion of the curved tongue 7, whereby the contact edge 7′ initially slides in parallel to the longitudinal axis of the terminal 2. Thus, the short circuiting is maintained until a well defined point is reached along the downward movement of the connector 20 just immediately prior to the end position of the connector 20 at which point the short circuit is interrupted. This feature has the advantage that the short circuit is maintained when the two connectors are joined in a faulty manner. Only when the fault is removed, will the short circuit be interrupted.

FIG. 1 further shows that the longitudinal edges or at least a portion 8 thereof may be deformed as shown to make sure that the spring body 3 retains the desired position inside the first connector after assembly. For example, the curved edges 8 may snap under a shoulder in the connector, whereby a rotation of the spring body around the terminal 1 is prevented. This feature also prevents the spring from falling out of the connector. This feature is also reinforced by the spring elements 22. Further, the larger aperture 5 does not need to be a hole entirely surrounded by the spring body. It is possible to open one side of the spring for a convenient entry of the terminal 2 into the hole 5 as long as it is made sure that there is no electrical contact between the edges of the hole 5 and the terminal 2. Thus, with one open side the spring body could be pushed onto terminal 1 and then rotated to partially surround terminal 2. Incidentally, the spring body 3 has a central axis 9 of symmetry extending intermediately and in parallel to the longitudinal edges of the spring body. Preferably, the apertures 4 and 5 are centered on the central axis 9 so that the axis 9 extends diametrically through the apertures 4 and 5.

The advantages of the short circuit spring according to the invention are seen especially in that it may be manufactured at little cost and that the material needed for making each spring is also minimal. Additionally, substantial economies are achieved in that the number of manufacturing steps is reduced to a minimum, whereby tapes and bands of the spring material may be used in a fully automated mass production procedure. Further, the spring so manufactured can be automatically assembled with the respective connector without the need for any additional insulating members. The function of the present spring for its short circuiting purpose is also assured even after frequently repeated connections and disconnections fo the two connectors. Due to the described curling action of the tongue 7 it is assured that the spring will not be exposed to an excessive cockin and the contact making edge 7′ can not cant or assume a position in which the intended short circuiting function is impaired. Also, the immediate reestablishment of the short circuit is assured when the two connectors are disengaged.

Although the invention has been described with reference to specific example embodiments, it will be appreciated, that it is intended, to cover all modifications and equivalents within the scope of the appended claims.

What is claimed is:

1. A short circuit spring for normally providing a short circuit between two electrical terminals of a first electrical connector, whereby said short circuit is established when the first connector is separated from a compatible second connector, comprising a leaf spring body having a substantially flat section at one end thereof and a curved section at the opposite end of said leaf spring body, said flat section having a first aperture located away from said curved section, said first aperture having such a size that one of said two electrical terminals fits snugly in an electrical contact making manner through said first aperture, and a second aperture in said flat section adjacent to said curved section, said second aperture having such a size that the other of said two electrical terminals passes through said second aperture and remains out of electrical contact with said flat section of said leaf spring body, said curved section forming a tongue which is bent back to normally contact said other electrical terminal under spring bias for maintaining said short circuit when said first and second connectors are separated, and for interrupting said short circuit when said first and second connectors are joined together, whereby said short circuit is reestablished upon separation of said first and second connectors.

2. The short circuit spring of claim 1, wherein said flat section of said leaf spring body has a substantially rectangular shape with long sides and narrow sides and a center axis in parallel to and intermediate said long sides, said first and second apertures being so located in said flat section that said center axis extends diametrically through both apertures.

3. The short circuit spring of claim 1, wherein said first aperture is somewhat smaller than a respective size of said one electrical terminal, said flat section further comprising a plurality of slots extending substantially radially away from said first aperture for forming a plurality of spring elements which contact said one electrical terminal in a force locking manner.

4. The short circuit spring of claim 1, wherein said leaf spring body comprises means for defining a definite position of the spring in said first connector.

5. The short circuit spring of claim 1, wherein said curved section has a free edge normally contacting said second electrical terminal for maintaining said short circuit under a spring bias of said curved section.

6. The short circuit spring of claim 1, wherein said curved section has a curvature corresponding approximately to that of a parabola, whereby an inner radius of said curvature is closer to said second aperture than an outer radius of said curvature and said tongue points toward said second electrical terminal.

7. The short circuit spring of claim 1, wherein said second aperture has a rectangular cross-section.

8. The short circuit spring of claim 1, wherein said flat section extends substantially perpendicularly to said electrical terminals extending in parallel to each other.

9. The short circuit spring of claim 1, used for providing a safety feature for pyrotechnical elements.

* * * * *